US008051873B2

(12) United States Patent
Mullen

(10) Patent No.: US 8,051,873 B2
(45) Date of Patent: Nov. 8, 2011

(54) WET WELL PUMPING SYSTEM AND METHOD OF INSTALLING AND SERVICING THE SYSTEM

(75) Inventor: Richard J. Mullen, Mount Kisco, NY (US)

(73) Assignee: G.A. Fleet Associates, Inc., Harrison, NY (US)

( * ) Notice: Subject to any disclaimer, the term of this patent is extended or adjusted under 35 U.S.C. 154(b) by 9 days.

(21) Appl. No.: 12/313,172

(22) Filed: Nov. 18, 2008

(65) Prior Publication Data

US 2010/0122744 A1 May 20, 2010

(51) Int. Cl.
*F04B 47/00* (2006.01)

(52) U.S. Cl. ..... 137/371; 417/360

(58) Field of Classification Search ..... 137/162, 137/364, 371; 417/36, 40, 360, 361
See application file for complete search history.

(56) References Cited

U.S. PATENT DOCUMENTS 3,112,760 A * 12/1963 Budd ..... 137/363
3,750,989 A * 8/1973 Bergeson ..... 248/650
3,938,545 A * 2/1976 Nagy et al. ..... 137/363
4,308,000 A * 12/1981 Oakes ..... 417/360
4,594,153 A * 6/1986 Weis ..... 210/104
4,661,047 A * 4/1987 Weis ..... 417/360
5,529,462 A * 6/1996 Hawes ..... 417/360
5,658,135 A * 8/1997 Sodergard ..... 417/360
6,648,002 B2 * 11/2003 Lappalainen ..... 137/205
2005/0214143 A1 * 9/2005 Stirling et al. ..... 417/423.9

* cited by examiner

*Primary Examiner* — John Fox
(74) *Attorney, Agent, or Firm* — Kirschstein, et al.

(57) ABSTRACT

A wet well pumping system and a method of installing and servicing the same in a wet well include mounting a pair of bent elbows having pump inlets and riser outlets on an alignment platform having a centerline, configuring the riser outlets to extend along longitudinal axes generally parallel to, and located at substantially equal distances from, the centerline of the platform, overlying the wet well with an alignment cover having a centerline and a pair of riser clearance holes, configuring the riser clearance holes to extend through the cover at the substantially equal distances from the centerline of the cover, passing a pair of upright risers through the riser clearance holes along longitudinal axes generally parallel to the centerline of the cover, aligning the longitudinal axes of the risers with the longitudinal axes of the riser outlets, connecting the risers to the aligned riser outlets, securing the platform to a floor of the well after the risers are connected to the aligned riser outlets, connecting a pair of submersible pumps inside the well to the pump inlets of the bent elbows, and pumping waste water from the well though the bent elbows and the risers to outside the well.

10 Claims, 6 Drawing Sheets

FIG. 3
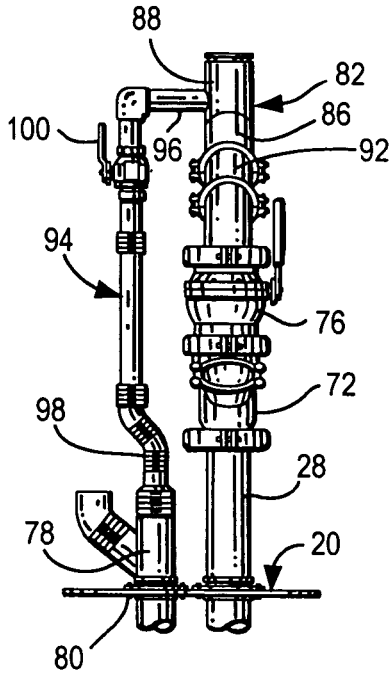
FIG. 4
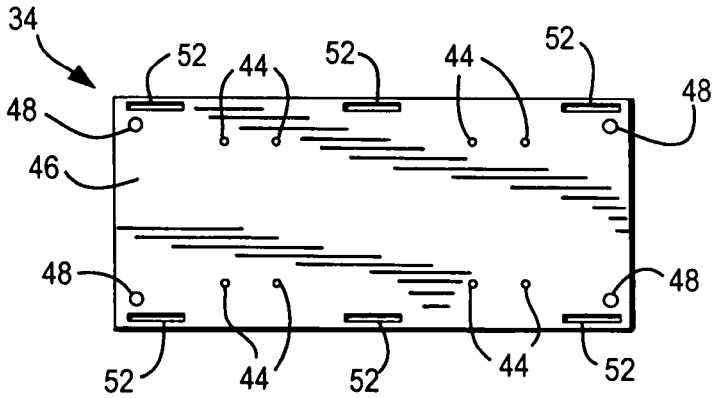
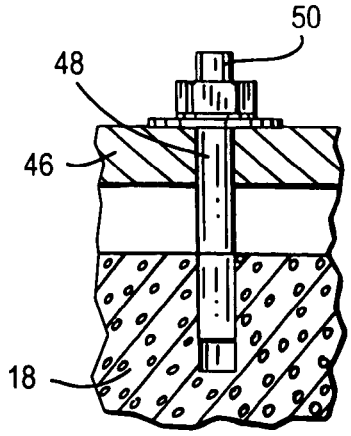
FIG. 5

FIG. 8
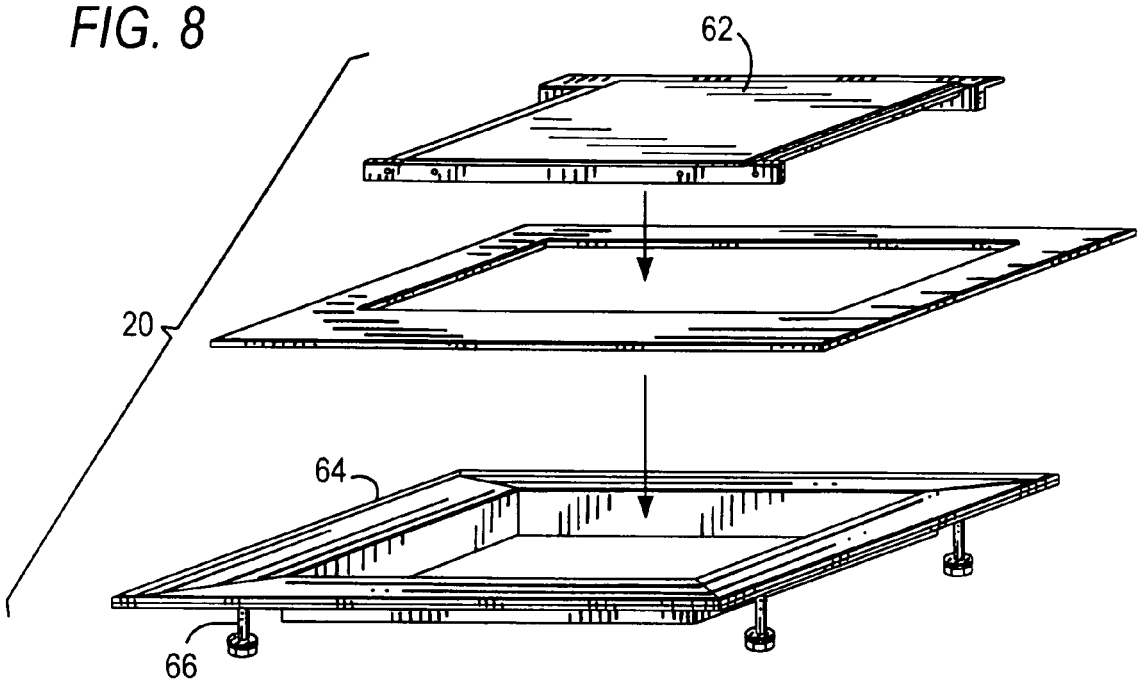
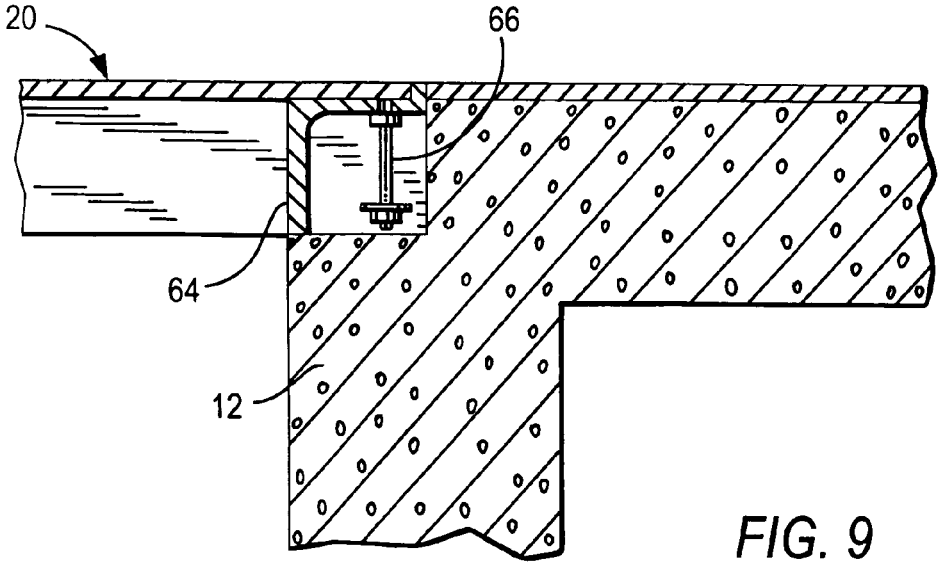
FIG. 9

WET WELL PUMPING SYSTEM AND METHOD OF INSTALLING AND SERVICING THE SYSTEM

BACKGROUND OF THE INVENTION

This invention generally relates to a wet well pumping system and, more particularly, to a method of installing and servicing the system for maintenance and replacement.

Wet well pumping systems for pumping waste water such as sewage, including liquid and solid waste, from community structures, such as domestic residences, office buildings, companies, industries, farms, institutions, and the like, to sewage or drainage pipes for treatment in a sewage treatment plant prior to safe, sanitary discharge, are well known. The sewage is typically collected in a wet well, which may be below or above ground. In a typical multi-story, office building application, the wet well is located below street level in the basement of the building and collects sewage from each floor, and the pumping system pumps the collected sewage back up to a street sewage pipe at a higher elevation. A typical pumping system includes one or more submersible pumps in the wet well and connected to one or more runs of discharge pipes that include elbows for changing direction from the horizontal to the vertical, as well as risers for changing elevation. The risers extend generally upwardly from inside the well, through a cover overlying the well, and outside the well to the street sewage pipe. Valves in the risers resist back flow of the sewage toward the pumps.

A new installation of such a wet well pumping system is often problematic, because the system is installed from the "bottom up" and is customized for each location. Typically, the well is fabricated with studs permanently anchored in the well floor. For example, in the case of a concrete-poured well, threaded studs extend upwardly from the poured concrete, and the pumps and the elbows are initially lowered into the well and bolted directly to the anchored studs. Then, the risers are connected to the elbows, and the risers are passed through clearance holes in the cover. Oftentimes, the risers are not properly aligned with these clearance holes. To achieve alignment, sometimes the clearance holes are enlarged on the job site. Sometimes, the pumps and/or the elbows have to be unbolted from the floor and jockeyed to new positions. Sometimes, the floor is not level at these new positions, thereby requiring further jockeying of the various system components until everything is more or less aligned. A custom installation is therefore both laborious and time consuming.

Servicing an installation of such a wet well pumping system is also often problematic. Removal and replacement or repair of broken or malfunctioning submersible pumps in the pumping system is time consuming, often requiring several personnel and exposing these personnel to possible unsafe conditions due to the possible accumulation of poisonous gases within the well. The service personnel are also exposed to possible environmental hazards from the wet and slick environment and the confined space within the well, as well as from possible electrical hazards associated with the connection of electrical wiring to the pumps from an electrical system. Furthermore, especially with the passage of time, inevitable corrosion between the pipes and the pumps cause them to fuse to each other and, as a consequence, the service personnel often have to break at least some of the pipes and/or bolts in order to service or replace a malfunctioning or broken pump.

SUMMARY OF THE INVENTION

One aspect of this invention is directed to a pumping system for, and a method of installing the pumping system in, a wet well for pumping waste water, typically sewage containing liquid and entrained solids, therefrom. The waste water could also be storm water, ground water, condensate, or drain water. A pair of bent elbows is mounted on an alignment platform as an assembly for placement on a floor of the well. The alignment platform has an upright or vertical centerline, and the elbows are equidistantly mounted, preferably bolted, on the platform at opposite sides of the centerline. Each bent elbow has a pump inlet and a riser outlet, preferably angularly disposed 90 degrees apart. The alignment platform serves as an alignment fixture to precisely locate and orient each pump inlet so that it faces along a horizontal direction within the well, and to precisely locate and orient each riser outlet so that it faces along the vertical direction within the well. The riser outlets extend along the vertical direction along a pair of longitudinal axes generally parallel to the centerline of the platform.

A pair of upright risers is connected to the riser outlets. An alignment cover is positioned to overlie the wet well. The alignment cover has an upright or vertical centerline, and is formed with a pair of circular riser clearance holes, preferably having annular seals therein. The riser clearance holes are equidistantly located on the cover at opposite sides of the centerline. The radial distance from a center of each riser clearance hole to the centerline of the cover is the same as the radial distance from the longitudinal axis of each riser outlet to the centerline of the platform. The upright risers are passed through, and sealed at, the riser clearance holes along a pair of mutually parallel longitudinal axes extending along the vertical direction. The alignment cover thus serves as another alignment fixture to precisely locate and orient the longitudinal axes of the risers in precise locations and orientations within the well so that the longitudinal axes of the riser outlets are aligned with the longitudinal axes of the risers.

Next, the platform is secured to the floor. Advantageously, a plurality of mounting or guide holes is preformed through the platform, and a corresponding plurality of threaded anchors are passed through the mounting holes, and the platform is anchored to the floor. The platform includes a base on which the elbows are directly mounted, and a plurality of legs for supporting the base at an adjustable height above the floor. These legs are adjusted to compensate for an irregular, non-planar floor and, in some retrofit applications, to overlie existing threaded studs already present in the floor. The elbows can thereupon be serviced and even replaced without removing the risers, since the elbows can be slid transversely out from underneath the risers along the base without mechanical interference from the studs, which are located below the base.

A pair of submersible pumps is connected to each pump inlet of the bent elbows. Each pump is operative for pumping the waste water from the well though the respective elbow and the respective riser to outside the well. The pair of pumps provide a failsafe redundancy in case one of the pumps fails.

Thus, not only is the structure of the pumping system new, but its installation is greatly simplified because of the use of the aforementioned alignment fixtures. The system is not custom installed from the "bottom up", that is, by initially anchoring the elbows to the floor as taught by the prior art, but instead, is installed in a standardized manner from the "top down", that is, by subsequently anchoring the elbows to the floor as one of the final installation steps. The platform is secured to the floor, after the risers are oriented in position. The pumps and the elbows are not bolted directly to the floor of the wet well as taught by the prior art. The clearance holes in the cover need not be enlarged to achieve alignment with the risers. The pumps and/or the elbows do not have to be unbolted from the floor, moved to new positions, and then rebolted to the floor to achieve such alignment. The installation according to this invention is performed with less labor, effort, time and expense. The non-customized, standardized nature of the installation allows components, for example, the submersible pumps, from different manufacturers to be used.

Advantageously, the cover has a frame initially fastened around a top opening of the well, and a hatch within the frame. The hatch is movable from a closed position in which the hatch blocks access to the well, and an open position in which the hatch enables access to the well. The hatch can be a door hinged to the frame, or the hatch can be completely removable from the frame to enable service personnel and the system components to have even greater access to the interior of the well.

A pair of check valves is respectively connected to the risers, preferably outside the well, to resist back flow of the waste water toward the pumps. A vent for venting the well advantageously extends through a vent clearance hole in the cover. The vent is in constant, open communication with the interior of the well and resists build up of gases, especially noxious fumes, inside the well. Preferably, a Y-shaped branch pipe having a pair of inlet arms is respectively connected to the risers. The Y-shaped branch pipe has a common outlet arm from which the waste water pumped by both pumps is discharged.

A blowdown piping circuit is also advantageously provided. The blowdown circuit has one end connected to the outlet arm of the Y-shaped branch pipe, and an opposite end in communication with the well, preferably by being connected to the vent. A valve in the blowdown circuit is closed to resist back flow of the waste water and to isolate the pressure inside the outlet arm, and is opened to enable such back flow of the waste water and to balance the pressures inside the outlet arm and the well.

The method of method of installing the pumping system in the wet well is advantageously performed by mounting a pair of bent elbows having pump inlets and riser outlets on an alignment platform having a centerline, configuring the riser outlets to extend along longitudinal axes generally parallel to, and located at substantially equal distances from, the centerline of the platform, overlying the wet well with an alignment cover having a centerline and a pair of riser clearance holes, configuring the riser clearance holes to extend through the cover at said substantially equal distances from the centerline of the cover, passing a pair of upright risers through the riser clearance holes along longitudinal axes generally parallel to the centerline of the cover, aligning the longitudinal axes of the risers with the longitudinal axes of the riser outlets, connecting the risers to the aligned riser outlets, securing the platform to a floor of the well after the risers are connected to the aligned riser outlets, connecting a pair of submersible pumps inside the well to the pump inlets of the bent elbows, and pumping waste water from the well though the bent elbows and the risers to outside the well.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a side elevational view of a detail of the system of FIGS. 1-2.

FIG. 4 is a bottom plan view of an alignment platform of the system of FIGS. 1-2;

FIG. 5 is a sectional view taken on the line 5-5 of FIG. 1 depicting one way of securing the alignment platform to a floor of the well;

FIG. 8 is an exploded perspective view of a part of another embodiment of an alignment cover at the top of the well with a removable hatch; and FIG. 9 is a sectional view of the hatch of FIG. 8 mounted at the top of the well.

DETAILED DESCRIPTION OF THE PREFERRED EMBODIMENTS

Figure 1:
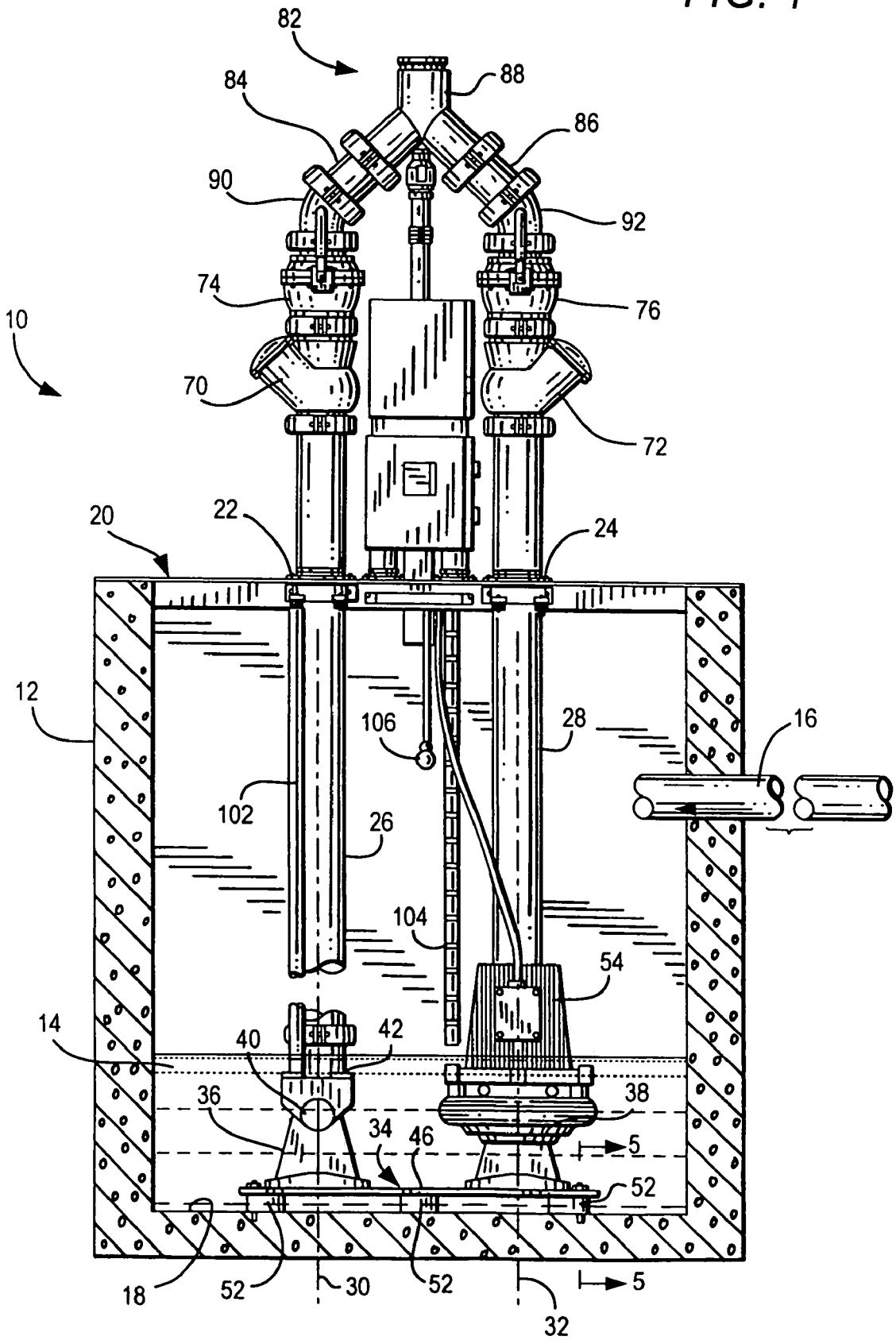
FIG. 1 is a part sectional, front elevational view showing a pumping system installed in a wet well in accordance with this invention.
Figure 2:
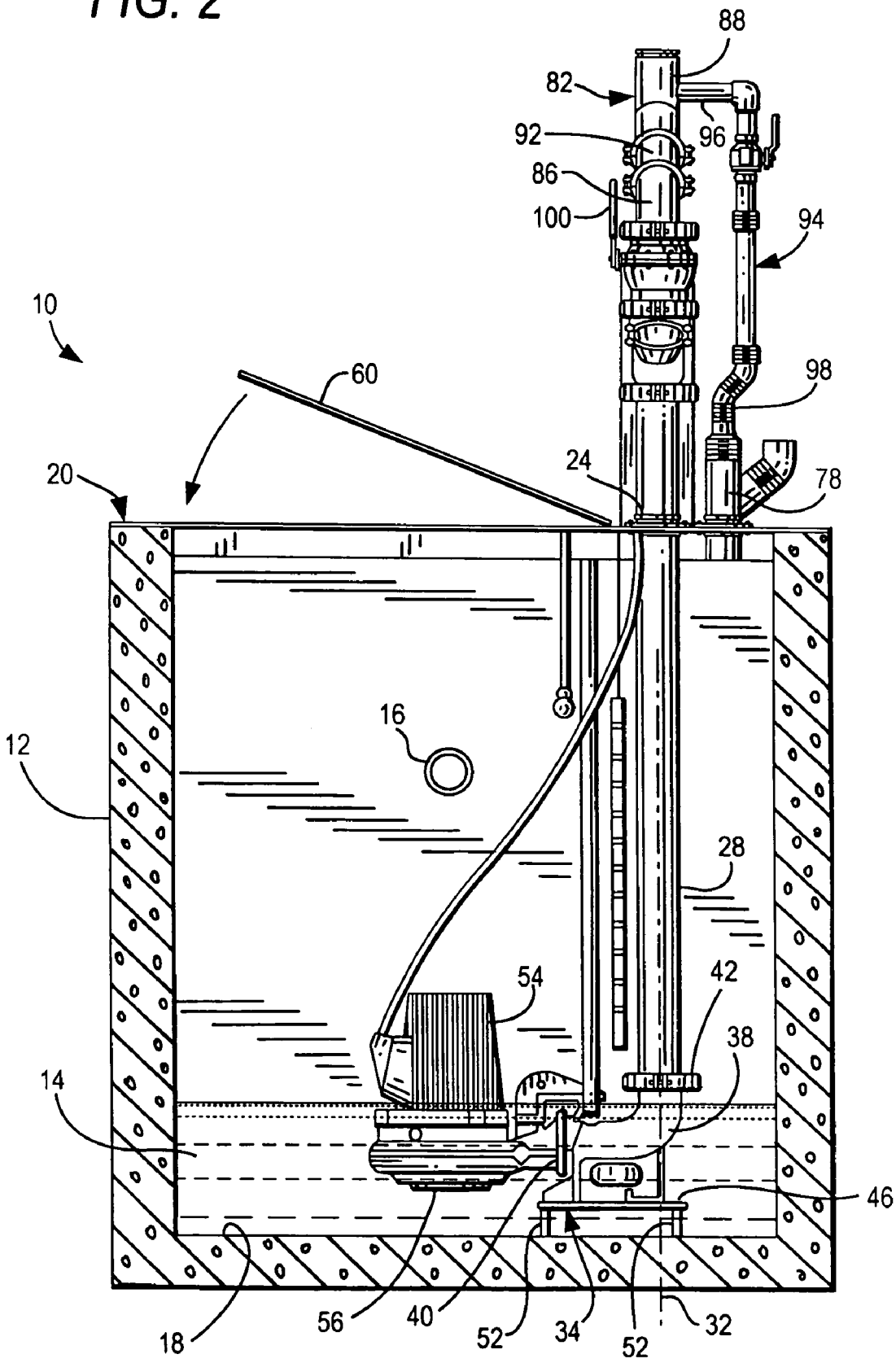
FIG. 2 is a side elevational view of the system and well of FIG. 1.

Referring now to the drawings, reference numeral 10 generally identifies a pumping system installed, in accordance with this invention, in a wet well 12 for pumping waste water 14, typically sewage with liquid and entrained solids, therefrom. The waste water 14 could also be storm water, ground water, condensate, or drain water. The well 12 is desirably constituted of concrete, masonry, steel or the like, and may either be above ground as a tank, or below ground as a pit. The waste water 14 is delivered from a community structure, as described above, to the well 12 via an inlet pipe 16. The pumping system 10 serves as a lift station to raise the waste water 14 from a lower elevation, for example, in a basement, to a higher elevation, for example, to a sewer line, typically for delivery to a sewage treatment plant.

A pair of bent elbows 36, 38 is mounted on an alignment platform 34 (see also FIG. 4) as an assembly for placement on a floor 18 of the well 12. The alignment platform 34 has an upright or vertical centerline, and the elbows 36, 38 are equidistantly mounted, preferably bolted, on the platform 34 at opposite sides of the centerline. Mounting holes 44 are used to secure the elbows 36, 38 to a base 46 of the platform 34. Each bent elbow 36, 38 has a pump inlet 40 and a riser outlet 42, preferably angularly disposed 90 degrees apart. The alignment platform 34 serves as an alignment fixture to precisely locate and orient each pump inlet 40 so that it faces along a horizontal direction within the well 12, and to precisely locate and orient each riser outlet 42 so that it faces along the vertical direction within the well 12. The riser outlets 42 extend along the vertical direction along a pair of longitudinal axes generally parallel to the centerline of the platform 34.

Figure 6:
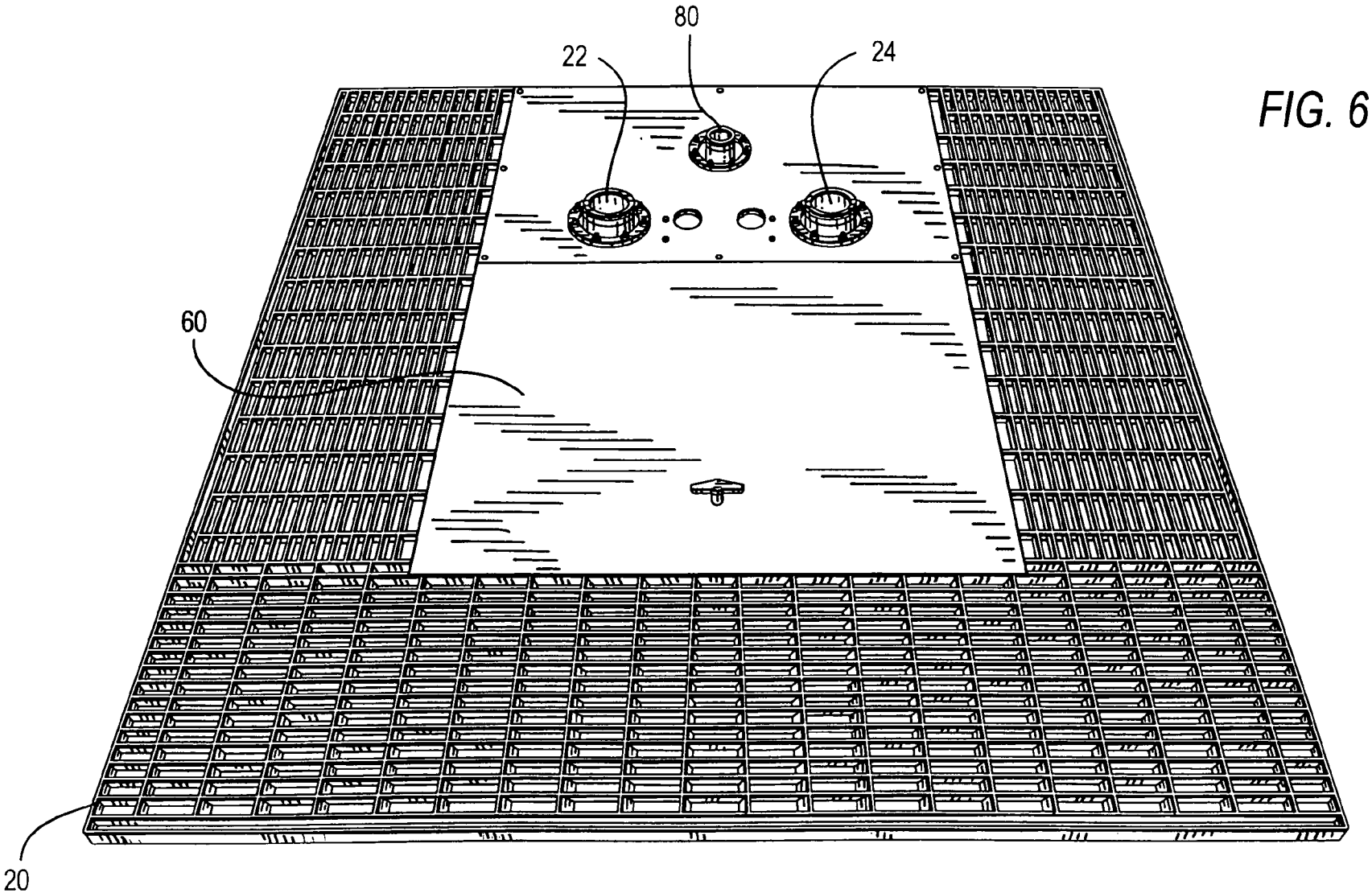
FIG. 6 is a perspective view of one embodiment of an alignment cover at the top of the well of FIGS. 1-2 with a hinged door in a closed position.

A pair of upright risers 26, 28 is connected to the riser outlets 42. An alignment cover 20 is positioned to overlie the wet well 12. The alignment cover 20 has an upright or vertical centerline, and is formed with a pair of circular riser clearance holes 22, 24 (also, see FIG. 6), preferably having annular environmental seals therein. The riser clearance holes 22, 24 are equidistantly located on the cover 20 at opposite sides of the centerline. The radial distance from a center of each riser clearance hole 22, 24 to the centerline of the cover 20 is the same as the radial distance from the longitudinal axis of each riser outlet 42 to the centerline of the platform 34. The upright risers 26, 28 are passed through, and sealed at, the riser clearance holes 22, 24 along a pair of mutually parallel longitudinal axes 30, 32 extending along the vertical direction.

The alignment cover 20 thus serves as another alignment fixture to precisely locate and orient the longitudinal axes 30, 32 of the risers 26, 28 in precise locations and orientations within the well 12 so that the longitudinal axes of the riser outlets 42 are aligned with the longitudinal axes 30, 32 of the risers 26, 28.

Next, the platform 34 is secured to the floor 18. Advantageously, a plurality of mounting or guide holes 48 (see FIG. 4) is preformed through the platform base 46, and a corresponding plurality of threaded anchors 50 (see FIG. 5) are passed through the mounting holes 48, and the platform 34 is anchored to the floor 18. The platform includes a plurality of legs 52 for supporting the base 46 at an adjustable height above the floor 18. These legs 52 are adjusted to compensate for an irregular, non-planar floor 18 and, in some retrofit applications, to overlie existing threaded studs already present in the floor 18. The elbows 36, 38 call thereupon be serviced and even replaced without removing the risers 26, 28, since the elbows 36, 38 can be slid transversely out from underneath the risers 26, 28 along the base 46 without mechanical interference from the studs, which are located below the base 46.

A pair of submersible pumps 54 (only one shown so as not to encumber the drawings) is connected to each pump inlet 40 of the bent elbows 36, 38. A guide rail 102 is connected between the cover 20 and each pump 54 to help support the pump. Each pump 54 has a downwardly facing intake 56 and is operative for pumping waste water 14 from the well 12 though the respective elbow 36, 38 and the respective riser 26, 28 to outside the well 12. A probe 104 detects the level of waste water in the well 12 to control the actuation of the pumps 54. A back-up float 106 serves as another detector of the level of waste water in the well. The pair of pumps provide a failsafe redundancy in case one of the pumps fails.

Thus, the pumping system 10 is installed from the "top down" without on-site customization. The platform 34 and the elbows 36, 38 are secured to the floor 18 as one of the final installation steps, after the risers 26, 28 are oriented in position. The pumps 54 and the elbows 36, 38 are not bolted directly to the floor 18 of the wet well 12 as taught by the prior art. The clearance holes 22, 24 in the cover 20 need not be enlarged to achieve alignment with the risers 26, 28. The pumps 54 and/or the elbows 36, 38 do not have to be unbolted from the floor 18, moved to new positions, and then rebolted to the floor 18 to achieve such alignment. The installation according to this invention is performed with less labor, effort, time and expense than heretofore. The non-customized nature of the installation allows components, for example, the submersible pumps 54, from different manufacturers to be used.

Figure 7:
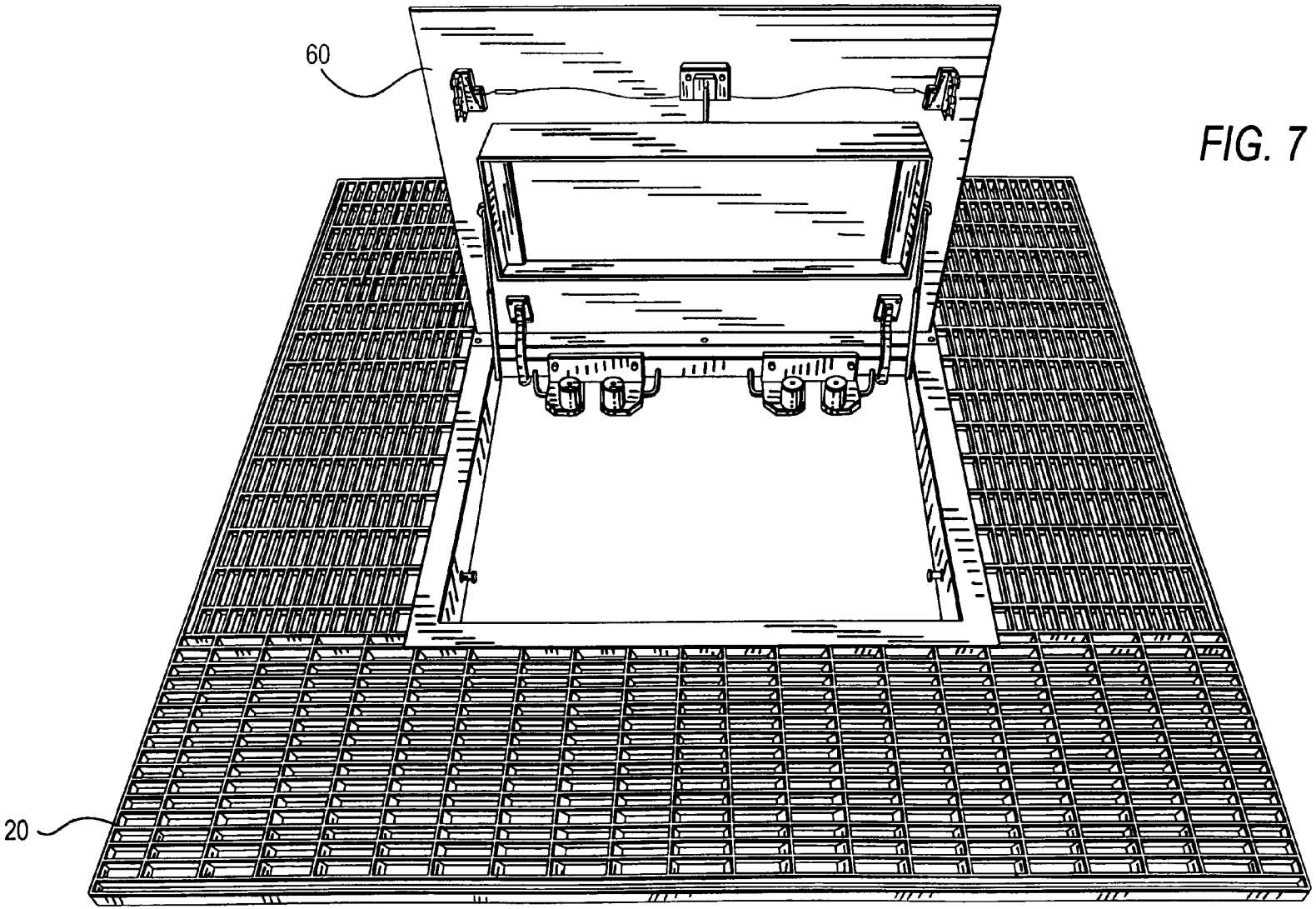
FIG. 7 is a perspective view of the alignment cover of FIG. 6 with the hinged door in an open position.

Advantageously, the cover 20 has an outer frame 64 initially fastened around a top opening of the well 12, and a hatch within the frame 64. The hatch can be a door 60 hinged to the outer frame 64 and movable with the aid of a handle from a closed position (FIG. 6) in which the door 60 blocks access to the well 18, and an open position (FIG. 7) in which the door 60 enables access to the well 18. The hatch can be an inner frame 62 (FIG. 8) that is completely removable from the outer frame 64 of the cover 20 to enable service personnel and the system components to have even greater access to the interior of the well 18. In FIG. 9, a set of leveling legs 66 is used to level the outer frame 64 at the top of the well 18.

A pair of check valves 70, 72 is respectively connected to the risers 26, 28, preferably outside the well 18, to resist back flow of the sewage 14 toward the pumps 54. A pair of ball valves 74, 76 is respectively connected to the check valves 70, 72. A vent 78 for venting the well 18 advantageously extends through a vent clearance hole 80 (see FIG. 6) in the cover 20. The vent 78 is in constant, open communication with the interior of the well 18 and resists build up of gases, especially noxious fumes, inside the well 18. Preferably, a Y-shaped branch pipe 82 having a pair of inlet arms 84, 86 is respectively connected to the risers 26, 28 via elbows 90, 92 whose opposite ends are angularly spaced apart by 45 degrees. The Y-shaped branch pipe 82 has a common outlet arm 88 from which the sewage 14 pumped by both pumps 54 is discharged.

A blowdown piping circuit 94 is also advantageously provided. The blowdown circuit 94 has one end 96 connected to the outlet arm 88 of the Y-shaped branch pipe 82, and an opposite end 98 in communication with the well 12, preferably by being connected to the vent 78. A valve 100 in the blowdown 94 circuit is closed to resist back flow of the waste water 14 and to isolate the pressure inside the outlet arm 88, and is opened to enable such back flow of the waste water and to balance the pressures inside the outlet arm 88 and the well 12.

It will be understood that each of the elements described above, or two or more together, also may find a useful application in other types of constructions differing from the types described above.

For example, the invention is not intended to be limited to the use of two pumps and two runs of discharge piping as described, but can equally apply to the use of a single pump and a single run of discharge piping. Also, more than two pumps and two runs of discharge piping could be used in certain applications. Each of the various components of the piping system is advantageously made from a corrosion-resistant material. Each of the connections between components is advantageously a quick connect-disconnect coupling.

While the invention has been illustrated and described as embodied in a wet well pumping system and method of installing and servicing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A method of installing a pumping system for replacement into an already installed wet well having a floor, comprising the steps of:

pre-assembling a platform assembly by commonly mounting a pair of bent elbows having pump inlets and riser outlets on a planar base of an alignment platform having a platform centerline, and positioning the bent elbows equidistantly at opposite sides of the platform centerline;

configuring the riser outlets to extend along longitudinal axes generally parallel to, and located at substantially equal distances away from, the platform centerline;

overlying the wet well with an alignment cover having a cover centerline and a pair of riser clearance holes;

configuring the riser clearance holes to extend through the cover equidistantly at opposite sides of the cover centerline at said substantially equal distances;

passing a pair of upright risers through the riser clearance holes along longitudinal axes generally parallel to the cover centerline;

aligning the longitudinal axes of the risers with the longitudinal axes of the riser outlets;

connecting the risers to the aligned riser outlets;

securing the pre-assembled platform assembly to the floor of the well after the risers are connected to the aligned riser outlets, and elevating the planar base of the alignment platform above, and generally parallel to, the floor;

connecting a pair of submersible pumps inside the well to the pump inlets of the bent elbows by locating the pumps remotely from the alignment platform; and pumping waste water from the well though the bent elbows and the risers to outside the well by elevating intakes of the pumps above, and in non-overlapping relationship with, the planar base of the alignment platform to freely pump the waste water without interference from the alignment platform.

2. The method of claim 1, and configuring the cover with a movable hatch, and moving the hatch from a closed position in which the hatch blocks access to the well, and an open position in which the hatch enables access to the well.

3. The method of claim 2, and completely removing the hatch from the cover in the open position.

4. The method of claim 1, and resisting back flow of the waste water toward the pumps.

5. The method of claim 1, and adjustably supporting the base at an adjustable height above the floor.

6. The method of claim 1, and venting the well by passing a constantly open vent through a vent clearance hole in the cover.

7. The method of claim 1, and respectively connecting a pair of inlet arms of a Y-shaped branch pipe to the risers, and discharging the waste water from an outlet arm of the Y-shaped branch pipe.

8. The method of claim 7, and connecting one end of a blowdown piping circuit to the outlet arm, and connecting an opposite end of the blowdown piping circuit to the well.

9. The method of claim 1, and adjustably positioning the base at an elevation above the floor.

10. The method of claim 9, and servicing at least one of the bent elbows without removing the risers by unsecuring the elbows from the base, and moving the bent elbows transversely of the longitudinal axes along the base.

* * * * *